United States Patent [19]

Adams

[11] Patent Number: 4,622,763

[45] Date of Patent: Nov. 18, 1986

[54] VAMP ASSEMBLY FOR AN ARTICLE OF FOOTWEAR

[75] Inventor: Thomas M. Adams, San Antonio, Tex.

[73] Assignee: Kaepa, Inc., San Antonio, Tex.

[21] Appl. No.: 592,262

[22] Filed: Mar. 22, 1984

[51] Int. Cl.[4] ..... A43B 11/00

[52] U.S. Cl. ..... 36/50; 36/51; 36/114

[58] Field of Search ..... 36/50, 51, 129, 11.5, 36/114

[56] References Cited

U.S. PATENT DOCUMENTS

| | | | |
|---|---|---|---|
| D. 83,790 | 3/1931 | Brown | 36/50 |
| D. 268,710 | 4/1983 | Anderie | 36/50 |
| 1,678,241 | 7/1928 | Benz | 36/50 |
| 2,643,469 | 6/1953 | Herceg | 36/50 |
| 3,546,796 | 12/1970 | Adams | 36/114 |
| 4,308,672 | 1/1982 | Antonious | 36/50 |
| 4,442,613 | 4/1984 | Dobbin | 36/50 |

FOREIGN PATENT DOCUMENTS

| | | | |
|---|---|---|---|
| 935640 | 10/1973 | Canada | 36/50 |

*Primary Examiner*—Werner H. Schroeder
*Assistant Examiner*—Mary A. Ellis
*Attorney, Agent, or Firm*—Cohn, Powell & Hind

[57] ABSTRACT

This vamp assembly includes a vamp providing upper and lower vamp sections interconnected by flexible fastener elements. The lower vamp section includes an inside vamp portion having connections for the fastener elements which are forwardly arranged relative to a corresponding connections provided on the outside vamp portion. The lower fastener elements are thereby arranged to apply diagonal tension forces to the opposed vamp portions when the fastener elements are tightened. The upper vamp section includes an inside vamp portion having connection for the fastener elements which are substantially conventionally arranged relative to a corresponding set of connections provided on the outside vamp portion so that the upper fastener elements are arranged to apply perpendicular tension forces to the opposed vamp portions when the fastener elements are tightened.

9 Claims, 9 Drawing Figures

VAMP ASSEMBLY FOR AN ARTICLE OF FOOTWEAR

BACKGROUND OF THE INVENTION

This invention relates generally to improvements in a vamp connection assembly for an article of footwear and more particularly to an assembly in which the transverse fastener elements in the lower portion of the vamp are arranged to apply forces to the lower vamp portion diagonally across the foot.

Up until a little over a decade ago conventional athletic shoes were provided with a single set of vamp sections having a single lace arranged symmetrically between the vamp sections.

In 1970 an improved athletic shoe was introduced having the same inventor as named in this application. This shoe disclosed in U.S. Pat. No. 3,546,796 provided for an athletic shoe having separate, or split, upper and lower vamp sections each having a lace so that the vamp sections were capable of independent adjustment to improve the fit of the shoe. A later development, disclosed in U.S. Pat. No. 4,200,998 also having the same inventor likewise provided upper and lower vamp sections but in lieu of a double lacing assembly provided a single lace having a clamp disposed between the upper and lower vamp sections which received the lace and again permitted individual adjustment for the upper and lower vamp sections. Both of the lacing arrangements adhered to the conventional symmetrical system by which the lacing tension was generally perpendicular to the axis of the foot.

One other patent of interest which discloses a shoe construction having diagonal lacing is U.S. Pat. No. 2,643,469 which discloses a lacing system intended to alleviate pressure in the area of the great toe which tends to produce bunions.

SUMMARY OF THE INVENTION

This vamp assembly for an article of footwear is particularly suitable for split vamp shoes and provides for the tension across the lower vamp area to be applied in a direction generally aligned with the metatarsal break to provide a more comfortable fit for the wearer.

This lacing assembly includes a vamp having upper and lower sections, each of the sections having oppositely disposed inside and outside vamp portions; connection means is provided on the upper inside vamp portion and on the upper outside vamp portion disposed in generally perpendicular relation and fastening means is provided between the upper vamp connection means tending to apply perpendicular tension to the upper vamp section when tension is applied to the fastening means; connection means is also provided on the lower inside vamp portion and the lower outside vamp portion, the connection means on the inside vamp portion being disposed forwardly of the corresponding connection means on the outside vamp portions and fastening means is provided between said lower vamp connection means tending to apply diagonal tension forces to the lower vamp section when tension is applied to the fastening means.

In one aspect of this invention, the fastening means is provided by laces and in another aspect of this invention the fastening means is provided by straps provided with hook and loop connection elements.

In another aspect of this invention the vamp section upper and lower portions are separated and individual fastening means are provided for the upper vamp portion and the lower vamp portion.

It is a further aspect of this invention to provide that the angle of inclination between corresponding connection means on the lower inside vamp portion and the lower outside vamp portion corresponds substantially to the metatarsal break.

In still another aspect of this invention the angle of inclination between the corresponding connection means on the lower inside vamp portion and the lower outside vamp portion is substantially thirty degrees (30°).

Still another aspect of this invention is to provide that the angle of inclination between corresponding connection means on the lower inside vamp portion and the lower outside vamp portion is substantially in the range between seventeen degrees (17°) and thirty-seven degrees (37°).

DESCRIPTION OF THE PREFERRED EMBODIMENT

Figure 1:
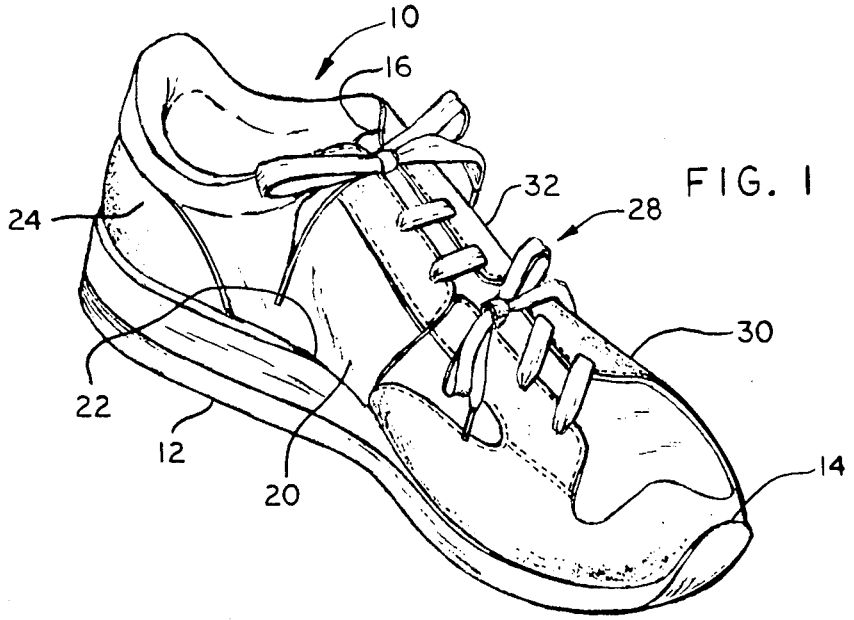
FIG. 1 is a perspective view of an athletic shoe having the lacing assembly.

Referring now by reference numerals to the drawings and first to FIG. 1 it will be understood that the shoe 10 includes a sole 12, a front toe portion 14, attached to the sole 12 and a tongue 16 integrally formed with said toe portion 14 and having a free upper end. The shoe 10 also includes opposed side portions 20 attached to the sole at their lower end 22 and side quarters 24. As shown, the shoe also includes a vamp generally indicated by numeral 28, providing a lower vamp section 30, disposed adjacent the toe portion 14, and an upper vamp section 32.

Figure 2:
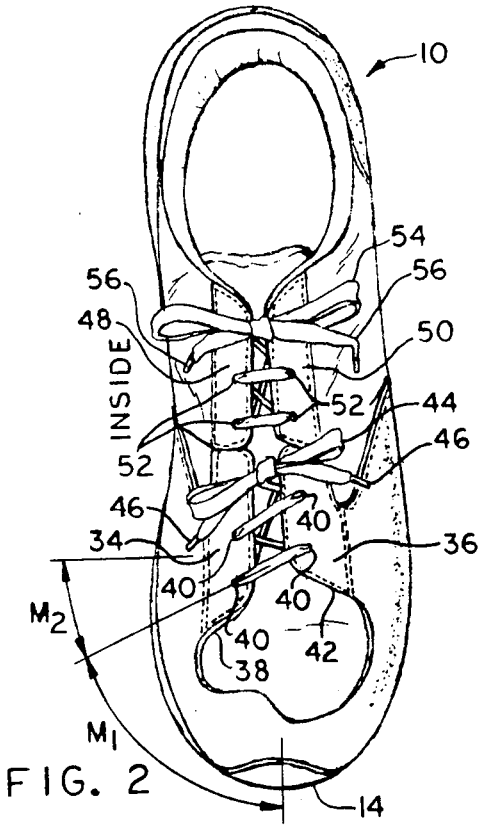
FIG. 2 is a plan view of the shoe showing the diagonal lacing.

As best shown in FIG. 2 the lower vamp section 30 includes inside and outside vamp portions 34 and 36 respectively. The inside vamp portion 34 is defined by a longitudinally extending margin having a forward portion 38, and including a plurality of eyelets 40, three in number in the preferred embodiment, said eyelets constituting lace-receiving connection means. The outside vamp portion 36 is defined by longitudinal margin having a forward portion 42 and a plurality of eyelets 40, three in number in the preferred embodiment. The lower vamp section is provided with a lace 44 having ends 46. The lace 44 provides a flexible element which is received by the eyelets 40 and said lace ends 46 are adapted to be tied in a bow thereby providing separate adjustment for the lower vamp section 30.

Importantly, the eyelets in the inside vamp portion are disposed forwardly of the corresponding eyelets in the outside vamp portion so that the diagonal axes extending between corresponding eyelets are generally parallel and, when the ends of the lace are tensioned, diagonal forces are applied tending to draw the inside and outside vamp portions together.

In the embodiment shown in FIG. 2 the foreward eyelets of both the inside and outside vamp portions of the lower vamp section are spaced a substantially equal distance from the forward margins 38 and 42 of the inside and outside lower vamp portions respectively. The angularity of the diagonally arranged eyelets departs from the conventional orientation, which of course is substantially perpendicular to the longitudinal axis of the foot, by approximately thirty degrees (30°). This angle shown as M2 corresponds to the complement of the angle of the metatarsal break M1 which has an idealized value of about sixty two degrees (62°) with a variation range of about plus or minus ten degrees (10°). The departure or complement angle is therefore ideally twenty eight degrees (28°) with a range of from seventeen degrees (17°) to thirty seven degrees (37°).

In the embodiment shown in FIG. 2, the upper vamp section 32 includes inside and outside portions 48 and 50 each having a plurality of eyelets 52, constituting lace-receiving connection means, which are disposed oppositely of each other on generally conventional perpendicular axes relative to the longitudinal axis of the foot. The upper vamp section is provided with a lace 54 having ends 56. The lace 54 provides a flexible element which is received by eyelets 52 and said lace ends 56 are adapted to be separately tied from the lower lace thereby providing separate adjustment for the upper vamp section 32. The conventional arrangement of the eyelets is such that when the upper lace is tensioned it applies a perpendicular force tending to draw the inside and outside vamp portions together.

Figure 3:
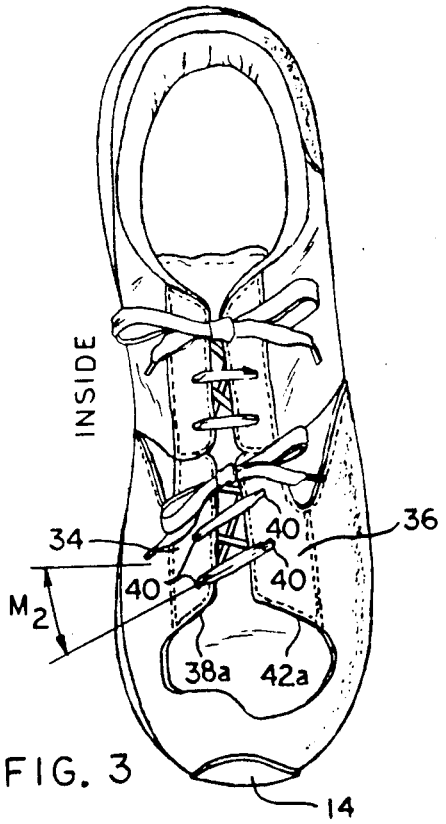
FIG. 3 is a plan view of a modified shoe.

A modified lacing assembly is shown in FIG. 3. This assembly is identical to that shown in FIG. 2 except that the lower margins 38*a* and 42*a* of the inside lower vamp portion 34 and the outside lower vamp portion 36 respectively are generally symmetrical so that the distance from the forward-most eyelet of the outside vamp forward margin 42*a* is greater than the corresponding distance of the forward eyelet of the inside vamp from the forward margin 38*a*.

Figure 4:
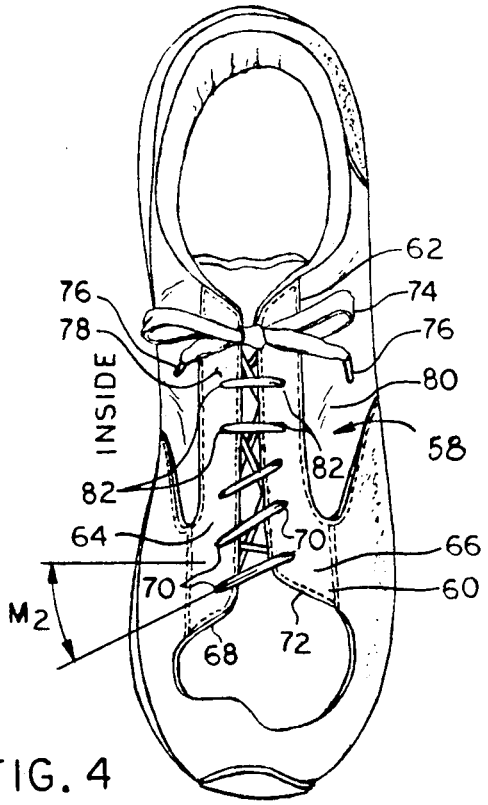
FIG. 4 is a plan view of another modified shoe.

Another modified lacing assembly is shown in FIG. 4 in which the vamp 58 includes integrally formed lower and upper sections 60 and 62. The lower vamp section 60 includes inside and outside vamp portions 64 and 66 respectively. The inside vamp portion 64 includes a forward margin 68 and a plurality of eyelets 70, three in number in the preferred embodiment. The outside vamp portion 66 includes a forward margin 72 and a plurality of eyelets 70 the eyelets in the inside lower vamp portion being disposed forwardly of corresponding eyelets in the outside vamp portion resulting in a diagonal lacing arrangement between corresponding eyelets such that the diagonal axes are disposed at an angle M2 relative to conventional eyelet arrangements similar to that discussed above with respect to FIG. 2.

The upper vamp section 62 includes an inside portion 78 and an outside portion 80 each having a plurality of eyelets 82 oppositely disposed in generally perpendicular relation.

The upper and lower eyelets 70 and 82 constitute lace-receiving means receiving the single lace 74. When the lower portion of the lace 74 received by eyelets 82 is tensioned by digital manipulation, such manipulation provides a diagonal tension force tending to draw the lower vamp portions together. When the upper portion of the lace is tensioned in the same way the resulting tension force is applied in a perpendicular direction tending to draw the vamp portions together.

Figure 9:
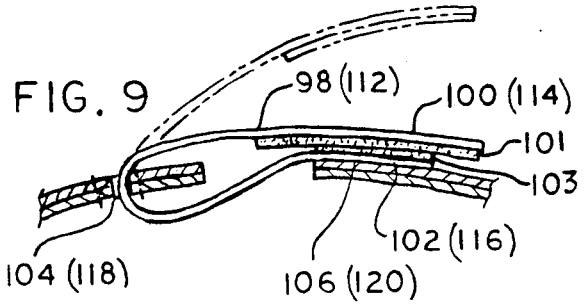
FIG. 9 is an enlarged section taken on line 9—9 of FIG. 8.
Figure 8:
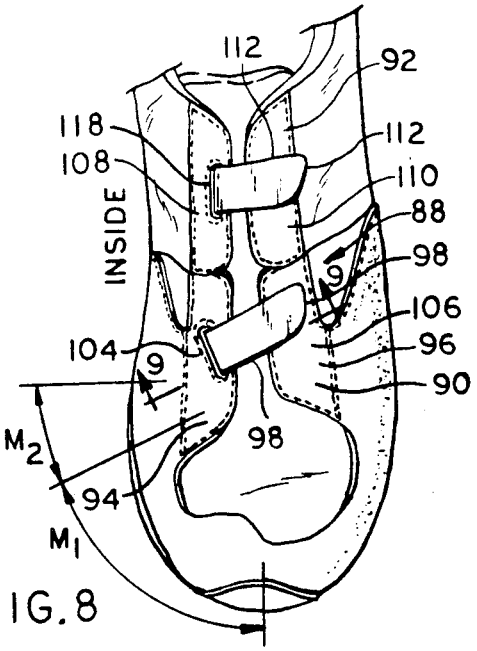
FIG. 8 is a plan view of another modified shoe.

Another modified assembly is shown in FIGS. 8 and 9. This assembly utilizes straps for the fastening means in lieu of laces. Insofar as the vamp is concerned this assembly is similar to the embodiment shown in FIG. 2 in that it includes a vamp 88 providing a lower vamp section 90 and an upper vamp section 92. The lower vamp section 90 includes inside and outside vamp portions 94 and 96 respectively interconnected by a strap 98 constituting a flexible element having opposed ends 100 and 102 providing cooperating hook and loop elements 101 and 103 respectively. The inside vamp portion 94 includes an elongate eyelet 104 receiving the strap 98 in snugly fitting relation and constituting a connection means for said strap generally perpendicularly oriented to said strap. As shown in FIG. 9, the outside vamp portion 96 includes a connection point 106 for one end of the strap which is attached to said vamp portion as by stitching. The stitching cooperates with a hook or loop element to provide a connection means for the strap. As clearly shown in FIG. 8 the elongate eyelet 104 connection point is disposed forwardly of the outside vamp portion connection point 106, so that the strap extending between corresponding connection means on the vamp portions assumes a diagonal configuration, and when the strap is tensioned, it applies a diagonal force tending to draw the inside and outside vamp portions together.

The upper vamp section 92 includes inside and outside vamp portions 108 and 110 interconnected by a strap 112 having opposed ends 114 and 116 providing cooperating hook and loop elements. The strap 112 is similar to strap 98 except as to length and orientation and the parts thereof are shown parenthetically in FIG. 9. The inside vamp portion 108 includes an elongate eyelet 118 receiving the strap 112 in snugly fitting relation. The outside vamp portion 110 includes a connection point 120 for one end of the strap which is attached to said vamp portion as by stitching. As clearly shown in FIG. 8 the elongate eyelet 118 and the connection point 120 are disposed perpendicularly opposite to each other so that the strap extending between the vamp portions assumes a perpendicular configuration relative to opposed connection points and when the strap is tensioned it applies a perpendicular force tending to draw the inside and outside vamp portions together.

It is thought that the structural features and functional advantages of this vamp assembly have become fully apparent from the foregoing description of parts, but for completeness of disclosure the adjustment of the fit of the vamp sections will be briefly described and first with respect to the embodiment shown in FIG. 2.

Figure 5:
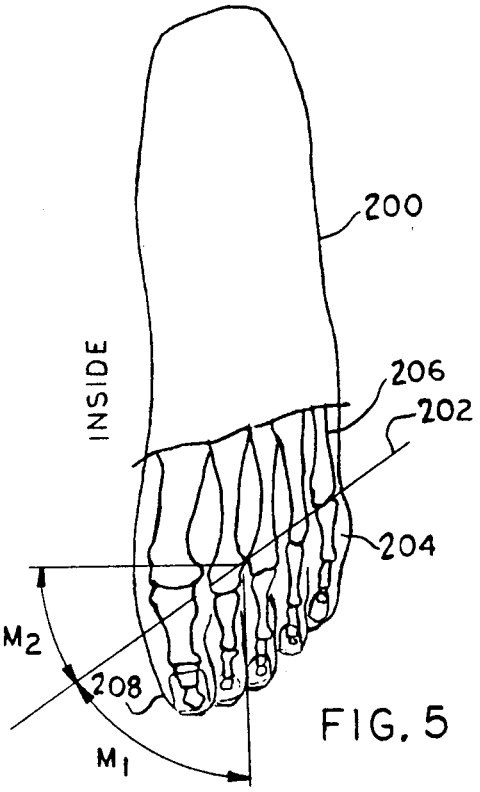
FIG. 5 is a schematic showing the foot.

FIG. 5 is a representation of a foot 200 showing the relative disposition of the metatarsus section 202 and the phalanges section 204. As shown the metatarsal break follows a line generally dividing the two sections insofar as the lesser toes are concerned, and passing from the joint of the little toe 206 to a point between the ends of the shaft of the great toe 208. Essentially, the metatarsal break follows generally the flex line at the base of the toes.

Figure 6:
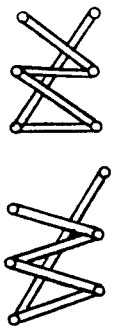
FIGS. 6 and 7 are schematics showing typical lace arrangements.
Figure 7:
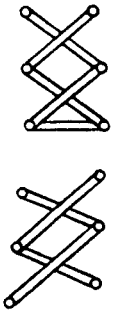

In the preferred embodiment the axis of the forward-most eyelets is angled rearwardly from the inside to the outside on a line substantially coincident with the metatarsal break. The result of angling the corresponding eyelets on the lower portion of the vamp is that when the lower lace is tensioned, as by pulling the lace ends, the fit across the lower foot portion tends to follow the flex line of the toes thereby providing a more comfortable fit to suit the wearer. With respect to the upper vamp portion, the eyelet orientation is conventional and the lace can be tensioned independently of the lower vamp portion to provide perpendicular pressure on this part of the foot, which has no joint line. FIGS. 6 and 7 are illustrative of two typical lacing arrangements which can be used to provide the desired diagonal forces in the lower vamp section and the perpendicular forces in the upper vamp section.

The action of the laces in the embodiment described with respect to FIG. 3 is identical with that described with respect to FIG. 2. With respect to FIG. 4 the lower, lace portions can be tensioned by digital manipulation, as by hooking the index finger under the laces and adjusting the fit, and then by adjusting the upper lace portions in the same way but tensioning the lace ends to achieve the desired fit prior to tying the bow.

With respect to the embodiment shown in FIG. 8 the adjustment is achieved simply by applying tension to the lower and upper straps independently and attaching the hook and loop elements at the remote end of the straps to their respective mating connection points on the outside vamp portions.

I claim as my invention:

1. In a vamp assembly for an article of footwear:

(a) a vamp including upper and lower sections, the lower section including inside and outside vamp portions and the upper section including inside and outside vamp portions disposed on opposite sides of the longitudinal axis of the foot, (b) connection means on the upper inside vamp portion and an equal number of connection means on the upper outside vamp portion, the connection means on the outside vamp portion being disposed oppositely of the corresponding connection means on the inside vamp portions in generally perpendicular relation to said longitudinal axis, (c) fastening means connected between said upper vamp portion connection means extending across said longitudinal axis tending to apply perpendicular tension forces to the upper vamp section when tension is applied to the fastening means, (d) connection means on the lower inside vamp portion and connection means on the lower outside vamp portion, the connection means on the inside vamp portion being disposed forwardly of the corresponding connection means on the outside vamp portion the angle of inclination between corresponding connection means on the lower inside vamp portion and the lower outside vamp portion corresponding substantially to the metatarsal break, and (e) fastening means connected between said lower vamp portion connection means extending across said longitudinal axis and tending to apply diagonal tension forces to the lower vamp section generally in the direction of the metatarsal break when tension is applied to the fastening means.

2. A vamp assembly as defined in claim 1, in which:

(f) the connection means on the upper inside and outside vamp portions is provided by a plurality of lace-receiving means and the connection means on the lower inside and outside vamp portions is provided by a plurality of lace-receiving means, and (g) the fastening means connecting said lower connection means is provided by a lace.

3. A vamp assembly as defined in claim 1, in which:

(f) the fastening means connected between said lower vamp section corresponding connection means includes a flexible member having opposed ends, and (g) one of said corresponding connection means includes cooperating hook and loop elements, one of said elements being attached to one end of said flexible member and the other of said elements being operatively attached to one of said vamp portions.

4. A vamp connection assembly for a shoe as defined in claim 1, in which:

(f) the lower inside vamp portion includes a forward margin and the lower outside vamp portion includes a forward margin, said inside forward margin being disposed forwardly of said outside forward margin.

5. A vamp assembly as defined in claim 1, in which:

(f) the upper and lower vamp sections are separated, and (g) the fastening means for the upper vamp section and the lower vamp section are provided by individual laces.

6. In a vamp assembly for an article of footwear:

(a) a vamp including upper and lower sections, the lower section including inside and outside vamp portions and the upper section including inside and outside vamp portions, (b) connection means on the upper inside vamp portion and connection means on the upper outside vamp portion the connection means on the outside vamp portion being disposed oppositely of the corresponding connection means on the inside vamp portions in generally perpendicular relation to the longitudinal axis of the foot, (c) fastening means connected between said upper vamp portion connection means tending to apply perpendicular tension forces to the upper vamp section when tension is applied to the fastening means, (d) connection means on the lower inside vamp portion and connection means on the lower outside vamp portion, the connection means on the inside vamp portion being disposed forwardly of the corresponding connection means on the outside vamp portion, and (e) fastening means connected between said lower vamp portion connection means tending to apply diagonal tension forces to the lower vamp section generally in the direction of the metatarsal break when tension is applied to the fastening means, (f) the angle of inclination between corresponding connection means on the lower inside vamp portion and the lower outside vamp portion being substantially thirty degrees (30°).

7. In a vamp assembly for an article of footwear:

(a) a vamp including upper and lower sections, the lower section including inside and outside vamp portions and the upper section including inside and outside vamp portions, (b) connection means on the upper inside vamp portion and connection means on the upper outside vamp portion the connection means on the outside vamp portion being disposed oppositely of the corresponding connection means on the inside vamp portions in generally perpendicular relation to the longitudinal axis of the foot, (c) fastening means connected between said upper vamp portion connection means tending to apply perpendicular tension forces to the upper vamp section when tension is applied to the fastening means, (d) connection means on the lower inside vamp portion and connection means on the lower outside vamp portion, the connection means on the inside vamp portion being disposed forwardly of the corresponding connection means on the outside vamp portion, and (e) fastening means connected between said lower vamp portion connection means tending to apply diagonal tension forces to the lower vamp section generally in the direction of the metatarsal break when tension is applied to the fastening means, (f) the upper and lower vamp sections being separated, the fastening means for the upper vamp section and the lower vamp sections being provided by individual laces, (g) the lower vamp section inside and outside portions including a plurality of lace-receiving eyelets, and (h) the angle of inclination between corresponding eyelets on the lower inside vamp portion and the lower outside vamp portion being substantially in the range between seventeen degrees (17°) to thirty-seven degrees (37°).

8. In a vamp assembly for an article of footwear:

(a) a vamp including upper and lower sections, the lower section including inside and outside vamp portions and the upper section including inside and outside vamp portions, (b) connection means on the upper inside vamp portion and connection means on the upper outside vamp portion the connection means on the outside vamp portion being disposed oppositely of the corresponding connection means on the inside, vamp portions in generally perpendicular relation to the longitudinal axis of the foot, (c) fastening means connected between said upper vamp portion connection means tending to apply perpendicular tension forces to the upper vamp section when tension is applied to the fastening means, (d) connection means on the lower inside vamp portion and connection means on the lower outside vamp portion, the connection means on the inside vamp portion being disposed forwardly of the corresponding connection means on the outside vamp portion, and (e) fastening means connected between said lower vamp portion connection means tending to apply diagonal tension forces to the lower vamp section generally in the direction of the metatarsal break when tension is applied to the fastening means, (f) the upper and lower vamp sections being separated, (g) the fastening means connected between said lower vamp section corresponding connection means including a flexible member having opposed ends, (h) one of said corresponding connection means including cooperating hook and loop elements, one of said elements being attached to one end of said flexible member and the other of said elements being operatively attached to one of said vamp portions, and (i) the angle of inclination of the flexible member being substantially in the range between seventeen degrees (17°) to thirty-seven degrees (37°).

9. In a vamp assembly for an article of footwear:

(a) a vamp including upper and lower sections, the lower section including inside and outside vamp portions and the upper section including inside and outside vamp portions disposed on opposite sides of the longitudinal axis of the foot, (b) a plurality of eyelets on the upper inside vamp portion and an equal number of eyelets on the upper outside vamp portion, the eyelets on the outside vamp portion being disposed oppositely of the corresponding eyelets on the inside vamp portion in generally perpendicular relation to said longitudinal axis.

(c) lace means received within said upper vamp portion eyelets extending across said longitudinal axis tending to apply perpendicular tension forces to the upper vamp section when tension is applied to the lace means, (d) a plurality of eyelets on the lower inside vamp portion and a plurality of eyelets on the lower outside vamp portion, the eyelets on the inside vamp portion being disposed forwardly of the corresponding eyelets on the outside vamp portion the angle of inclination between corresponding connection means on the lower inside vamp portion and the lower outside vamp portion corresponding substantially to the metatarsal break, and (e) lace means received within said lower vamp portion eyelets extending across said longitudinal axis and tending to apply diagonal tension forces to the lower vamp section generally in the direction of the metatarsal break when tension is applied to the lace means.

* * * * *